US008495795B2

(12) United States Patent
Christie et al.

(10) Patent No.: US 8,495,795 B2
(45) Date of Patent: Jul. 30, 2013

(54) TOP PIN DOOR ASSEMBLY WITH HOLD OPEN DEVICE

(75) Inventors: Anthony K. Christie, Wayland, MI (US); John Early, Portage, MI (US)

(73) Assignee: Eliason Corporation, Portage, MI (US)

( * ) Notice: Subject to any disclaimer, the term of this patent is extended or adjusted under 35 U.S.C. 154(b) by 0 days.

(21) Appl. No.: 13/404,563

(22) Filed: Feb. 24, 2012

(65) Prior Publication Data

US 2012/0297577 A1 Nov. 29, 2012

Related U.S. Application Data

(60) Provisional application No. 61/463,984, filed on Feb. 25, 2011.

(51) Int. Cl.
*E05F 1/02* (2006.01)

(52) U.S. Cl.
USPC ..... 16/313; 16/315

(58) Field of Classification Search
USPC ..... 16/312, 313, 280, 293, 309, 315, 16/348, 352, 353; 49/410, 412, 409; 160/245–347, 123, 167 R, 167 V, 168.1 R, 160/174 R, 176.1 R
See application file for complete search history.

(56) References Cited

U.S. PATENT DOCUMENTS

| | | | | | |
|---|---|---|---|---|---|
| 1,630,200 | A | * | 5/1927 | Merrill | 49/42 |
| 2,267,249 | A | * | 12/1941 | Monner | 160/382 |
| 2,920,340 | A | * | 1/1960 | Hopkins | 16/248 |
| 3,160,913 | A | * | 12/1964 | Carey | 16/315 |
| 3,289,244 | A | * | 12/1966 | Carey | 16/315 |
| 3,367,613 | A | * | 2/1968 | Christensen | 248/145 |
| 3,858,274 | A | * | 1/1975 | Burton et al. | 16/312 |
| 5,025,531 | A | * | 6/1991 | McCarty | 16/313 |
| 5,265,311 | A | * | 11/1993 | Gard | 16/312 |
| 5,613,276 | A | * | 3/1997 | Franz | 16/229 |
| 6,161,255 | A | * | 12/2000 | Garrett | 16/284 |

FOREIGN PATENT DOCUMENTS

JP 2012202091 A * 10/2012

* cited by examiner

*Primary Examiner* — Chuck Y. Mah
(74) *Attorney, Agent, or Firm* — Miller Canfield Paddock and Stone; Mark L Maki

(57) ABSTRACT

An improved top pin assembly is provided for a traffic door which integrally is provided with a hold open device for maintaining the door in either one of opposite fully open positions.

17 Claims, 6 Drawing Sheets

TOP PIN DOOR ASSEMBLY WITH HOLD OPEN DEVICE

CROSS REFERENCE TO RELATED APPLICATIONS

This application claims priority of U.S. Provisional Patent Application No. 61/463,984, filed Feb. 25, 2011, the disclosure of which is incorporated herein by reference in its entirety.

FIELD OF THE INVENTION

The invention relates to a top pin assembly for a swinging door, and more particularly, to a top pin assembly with a hold open device maintaining the door in an open position.

BACKGROUND OF THE INVENTION

Traffic doors are typically used in commercial establishments to allow two-way traffic through a doorway. Such doors may be used in a variety of such establishments including supermarkets, restaurants, retail stores, hospitals, walk-in coolers, etc.

The doors may be provided singly or in pairs, and mount to a door frame by hinges which allow the doors to freely swing in opposite directions, i.e. both inwardly into a room and outwardly from the room. In a commercial establishment, this allows employees to freely move between two adjacent rooms merely by pushing on the freely, swingable doors wherein the doors automatically return to the closed position without any further action from the employee, which thereby facilitates the traffic flow of employees from room to room.

More particularly, such traffic doors also have a hinge arrangement connecting each door to a door frame which allows the doors to swing in opposite directions, but also gently closes or returns the door to a closed or "rest" position blocking the doorway. Examples of such a hinge assembly are disclosed in U.S. Pat. Nos. 3,160,913 and 3,289,244, which patents were obtained by the assignee of the present invention. The disclosures of these patents are incorporated herein by reference in their entirety. These hinge assemblies operate to close the door without the need for a spring arrangement that would generate a spring force to bias the doors to a closed position. Rather, the hinge assemblies disclosed in these patents use a roller assembly which generates a closing action on the doors by gravity acting upon the door itself.

A specific example of such traffic doors is the family of doors sold by the present assignee, namely Eliason Corporation, under its EASY SWING® trademark.

It is an object of the invention to provide an improved door assembly of this general type which incorporates an improved hinge assembly which serves to releasably restrain the door in both a closed position, and in open positions preferably oriented at right angles relative to the closed position.

The invention relates to an improved door assembly which positively restrains the door in a normally closed position. The improved door assembly preferably includes an improved top pin assembly which not only provides positive restraining of the door in the closed position, but also allows for positive restraining of the door in at least two fully open positions, preferably oriented at right angles relative to this closed position. In this manner, the top pin assembly provides integral restraining of the door, such that separate external restraining devices are not required to maintain the door in the open position. This allows for free traffic flow through the doorway for individuals who may be carrying bulky or heavy loads, or pushing carts. Where the traffic volume is high, at least on a temporary basis, the top pin hinge assembly allows the door to simply be opened to the fully open position wherein the top pin assembly automatically holds the door in this position until the door is manually pushed in the direction of closing which then causes the door assembly to automatically return to the fully closed position.

Other objects and purposes of the invention, and variations thereof, will be apparent upon reading the following specification and inspecting the accompanying drawings.

Figure 1:
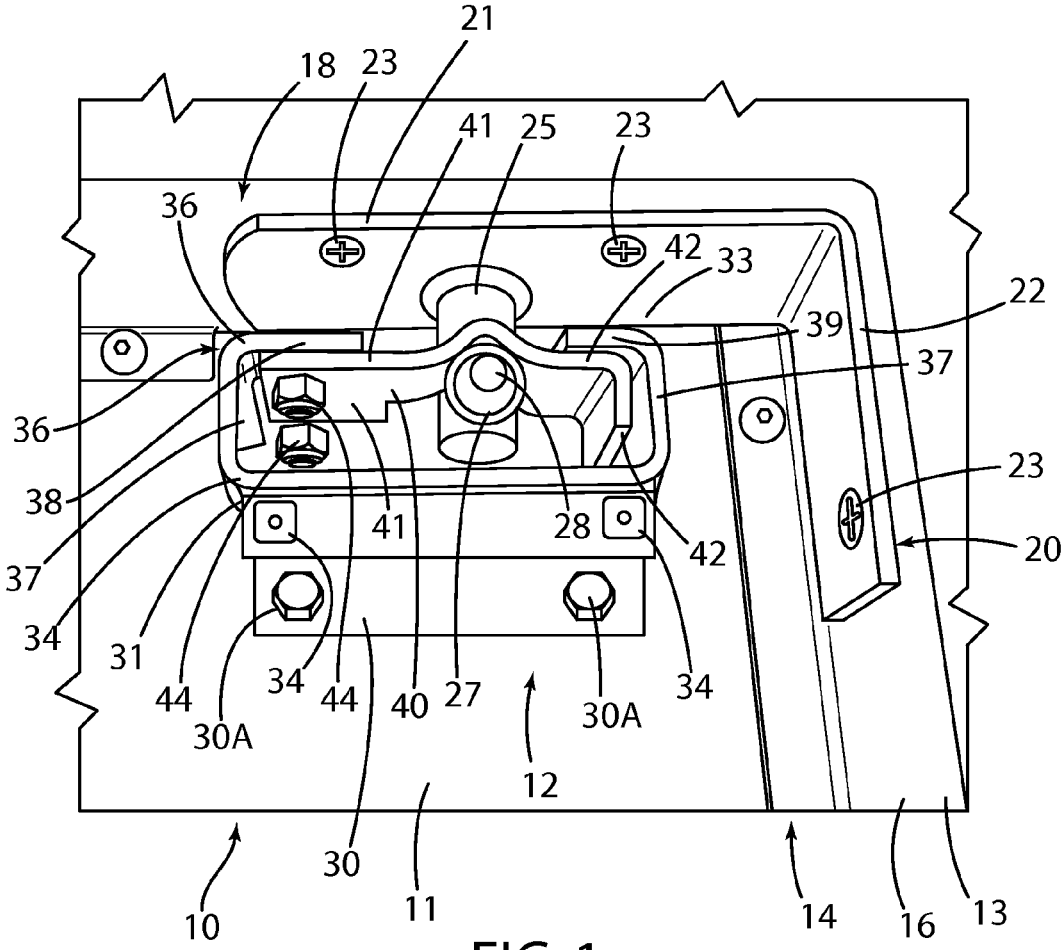
FIG. 1 is a perspective view of a door with a top pin door assembly having a hold open device.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
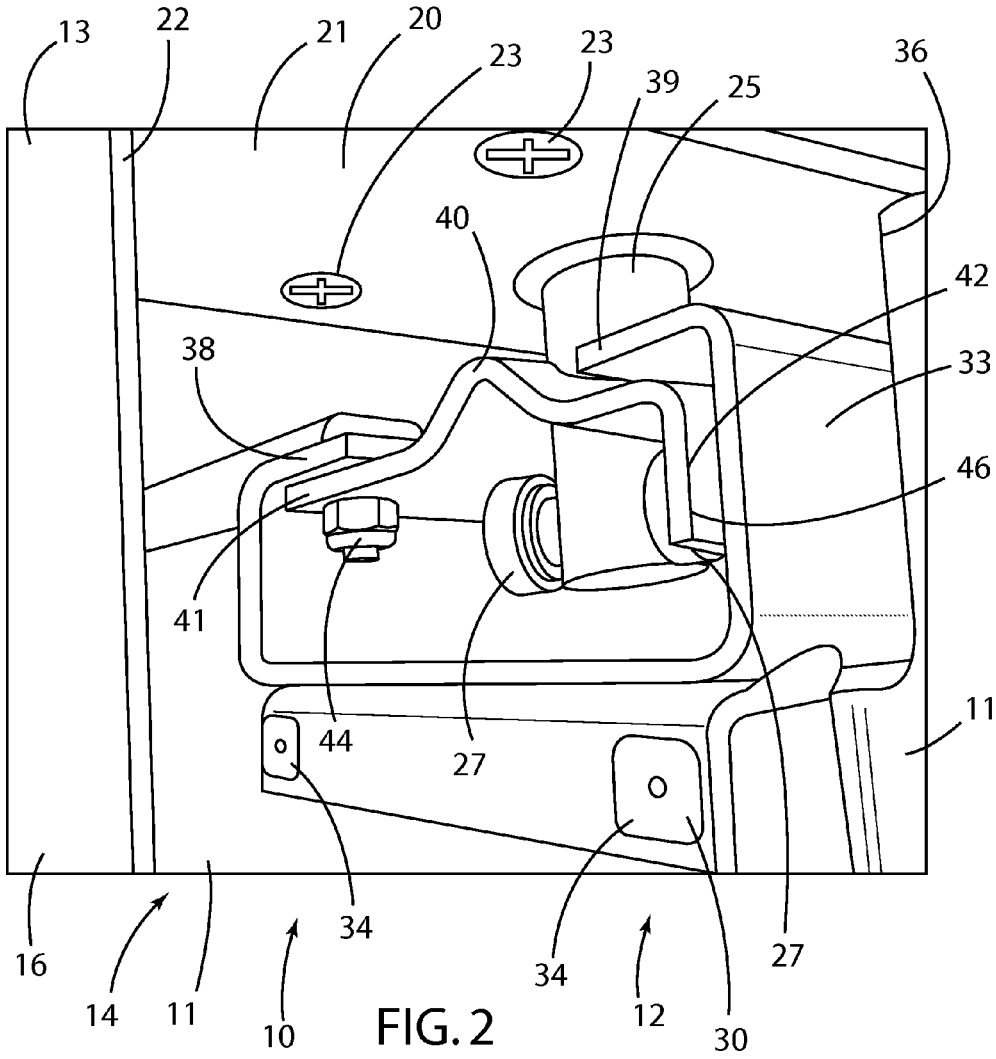
FIG. 2 is a perspective view of the top pin assembly with the door in an open condition.

Referring to FIGS. 1 and 2, an improved door assembly 10 comprises a panel-like door 11 which is connectable by bracketry, namely a top pin assembly 12 and a lower bracket, which mount to the frame 13 of a doorway 14. More particularly, the doorway 14 typically extends through a partition wall such as the wall of a building or the wall of a cooler. The doorway 14 is defined by a bottom threshold or floor, upright door jambs 16 and a crosswise header 18. The jambs 16 and the header 18 typically have a side-to-side width which is defined by the thickness of the partition wall and has a conventional rectangular shape.

As seen in FIG. 1, the top pin assembly 12 connects to the inside faces of one of the jambs 16 and the header 18, and to the door 11, wherein the door 11 is pivotally connected to such top pin assembly 12 to permit swinging movement of the door 11 in opposite swinging directions. As such, the top pin assembly 12 permits bidirectional swinging movement of the door 11 between the closed position of FIG. 1 and a first open position of FIG. 2 wherein the door is at a right, 90 degree angle relative to the closed position.

As seen in FIG. 1, the door 11 includes the top pin assembly 12 in the upper corner thereof which cooperates with the door frame to effect a self-centering of the door 11 so as to generally be centered within the doorway 14 widthwise of the partition wall in the closed position of FIG. 1. The top pin assembly 12 comprises a box-like cover (not illustrated)

which provides selective access to the top pin assembly 12 so that it is accessible from the side as seen in FIG. 1.

The top pin assembly 12 not only biases the door 11 to the closed position of FIG. 1, but also includes a hold open feature which holds the door 11 open in either the first open position of FIG. 2 or a second open position wherein the door is oriented 180° relative to the first open position of FIG. 2. In this second open position, the door is still oriented at the right, 90° angle relative to the closed position (FIG. 1) after the door 11 has been swung in the opposite direction.

More particularly as to the top pin assembly 12, the top pin assembly 12 first comprises a hinge bracket 20 which comprises a horizontal leg 21 and a vertical leg 22 which are respectively secured to the header 18 and jam 16 by suitable fasteners 23, which are preferably screws. The hinge bracket 20 includes a downwardly extending, fixed hinge post or pin 25 which is preferably welded to the horizontal bracket leg 21. The bottom or terminal end of the hinge pin 25 includes a pair of diametrically opposed rollers 27 located on diametrically opposite sides of the pin 25. The rollers 27 are rotatably supported upon a shaft 28 which extends diametrically through the end of the pin 25, wherein the free ends of the shaft 28 each support a respective one of the rollers 27 thereon. The pin 25 thereby extends downwardly in a vertical orientation and rotatably supports the rollers 27 thereon. The hinge bracket 20 and hinge pin 25 thereby remain in stationary fixed positions during use. As will be described hereinafter, the remaining components of the top pin assembly 12 described below are rotatably suspended from the top pin 25 by the rollers 27 and are fastened to the door, which thereby allows the door 11 to swing between the open and closed positions.

To support the door 11 upon the rollers 27, the top pin assembly 12 further comprises base brackets 30, one of which is located on one side of the door and includes a top flange 31 on which a generally C-shaped housing 33 is rigidly affixed. A similar base bracket 30 is also provided on the opposite side of the door 11 wherein the two base brackets 30 align with each other and are secured to the door 11 by a pair of bolts 30A which pass entirely through the door 11, engage both of the base brackets 30, and effectively clamp the door 11 between the two base brackets 30. A respective cover is provided so as to overlie each side of the door 11 and enclose this hardware, including the base brackets 30, during use. The C-shaped housing 33 extends through the entirety of the door 11 and is fastened to each of the base brackets 30, such as by welding, so that the entire assembly is secured to the door 11 by the aforementioned bolts 30A. The base bracket 30 includes a pair of fastener blocks 34 which allow for affixing of the cover thereto.

More particularly, the housing 33 comprises a bottom wall 34 which extends horizontally through a notch 36 (FIG. 1) which is formed in the upper corner of the door. The bottom wall 34 is welded to the base brackets 30 as mentioned above. The housing 33 further comprises vertical side walls 37 which in turn are bent inwardly at their tops to define a first housing leg 38 and a second housing leg 39. These housing legs 38 and 39 are spaced apart from each other to define a gap through which the support pin 25 may extend vertically as seen in FIGS. 1 and 2.

To mount the door 11 to the pin 25, the top pin assembly 12 further comprises a top support plate 40 which has opposite first and second ends 41 and 42. A first plate end 41 (as seen in FIGS. 3A, 3B, 4 and 5) is substantially flat and includes a pair of bore holes 43 for fixed securement of the support plate 40 to the main housing 34. In this regard, the first plate end 40 is disposed beneath the housing flange 38 and is secured thereto by a pair of threaded bolts or other fasteners 44 as seen in FIG. 1. As such, when the rollers 27 engage the support plate 40, the weight of the door is carried on the plate ends 41 and 42 through the housing flanges 38 and 39. The opposite plate end 42 is formed with a structure rigidifying downwardly depending leg 46 wherein the second plate end 42 in turn is disposed below in load-bearing relation with the housing flange 39 as seen in FIGS. 1 and 2. Hence, when the support plate 40 is fastened in place by the bolts 44, all of the load of the door is carried by the top pin 25 through the engagement of the rollers 27 with the plate 40.

The plate 40 is formed with a central bore 49 (FIGS. 3A and 3B) to allow the hinge post 25 to extend vertically therethrough. The central portion of the plate 40 includes two V-shaped centering notches 50 in which the rollers 27 seat when in the position of FIG. 1. Preferably, the support plate 40 is pre-attached to the hinge pin 25 by inserting the plate 40 over the free end of the pin 25 prior to installation of the rollers. After this pre-assembly step, the rollers 27 are then affixed to the bottom terminal end of the hinge pin 25 by installation of the rollers 27 in the shaft 28. Once the rollers 27 are installed in this manner, the support plate 40 is no longer removable from the pin 25.

During assembly of the door, the housing 34 has already been installed on the door 11 through the base brackets 30 and the associated bolts 30A. The aforementioned gap between the housing flanges 38 and 39 then allows the door to be lifted and shifted sidewardly until the support plate 40, previously attached to the pin 25, is inserted below the flanges 38 and 39 and the door 11 is pre-hung from the support plate 40 and the engaged hinge pin 25. The door 11 is still in a loose condition, but is affixed to the support plate 40 by installation of the fasteners 44 which thereby prevents the door 11 from being removed from the hinge pin 25 and the associated hinge bracket 20. Notably, the hinge bracket 20 has already been installed on the door frame, such that the assembly of the door 11 and its suspension from the support plate 40 thereby positions the door 11 within the doorway. A bracket is also provided at the bottom corner of the door to fix the location of the door corner relative to the door frame. In this manner, the door 11 is now functional or swingable between the open and closed positions described below.

During rotation of the door, the rollers 27 roll along the bottom side of the centering notch 50 which allows the door to swing openly. However, the weight of the door and the inclined surfaces of the centering notch 50 also perform a biasing or centering action on the door 11 to return the door 11 to the normally closed position of FIG. 1.

Figure 3A:
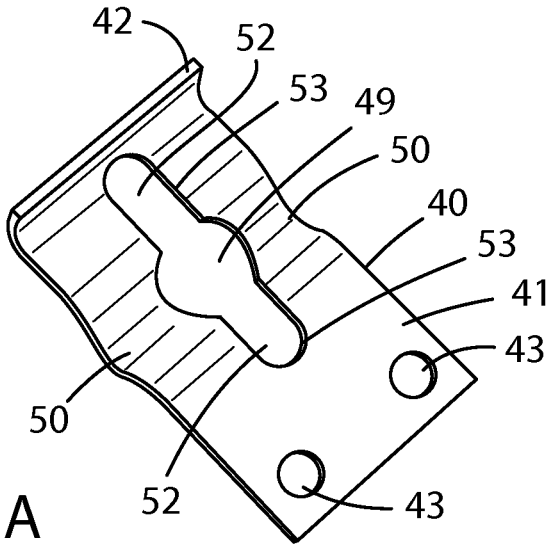
FIG. 3A is a perspective view of a support plate.
Figure 3B:
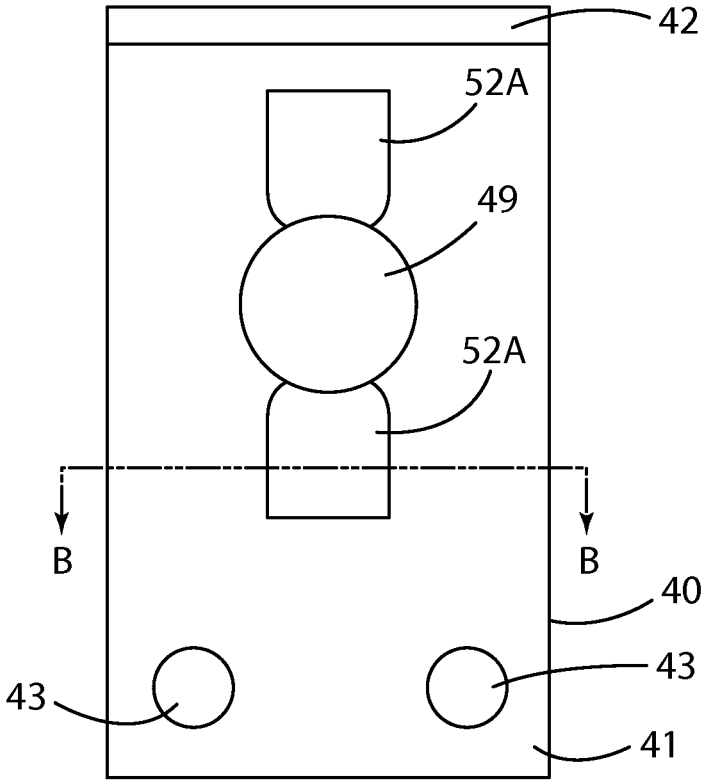
FIG. 3B is a bottom view of the support plate.
Figure 4:
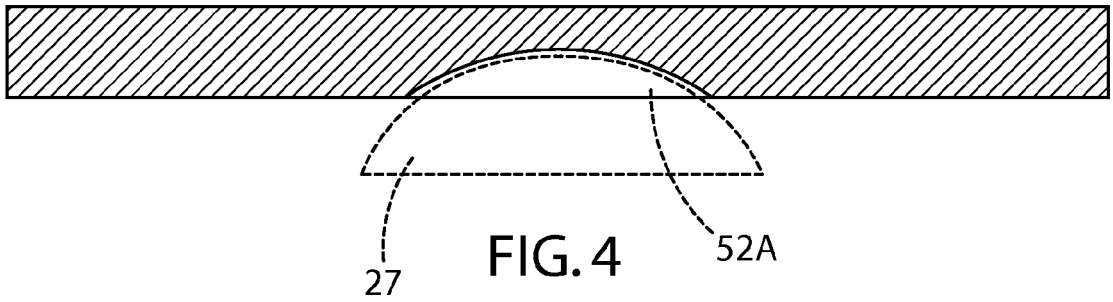
FIG. 4 is a side cross-sectional view of the support plate.
Figure 5:
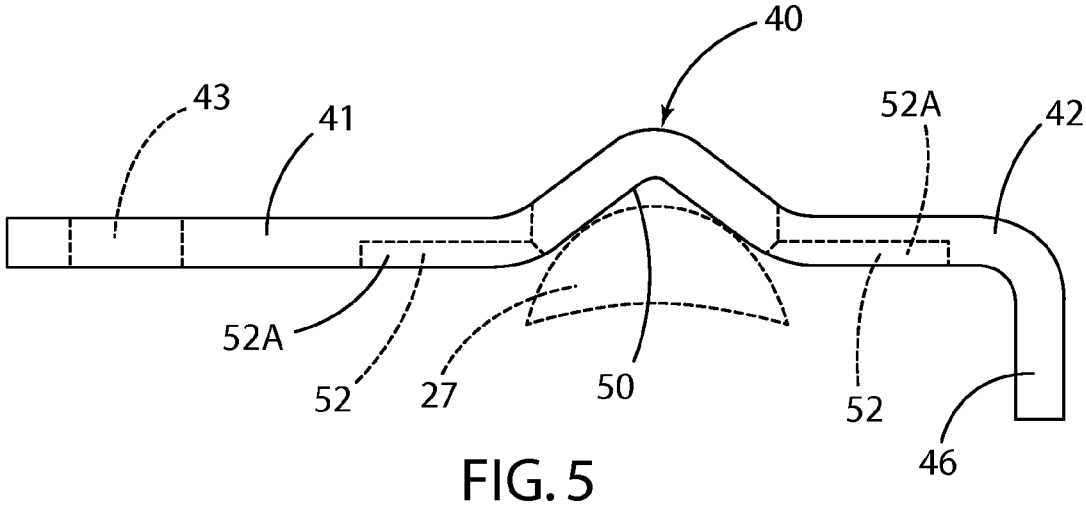
FIG. 5 is a side view of the support plate.
Figure 6:
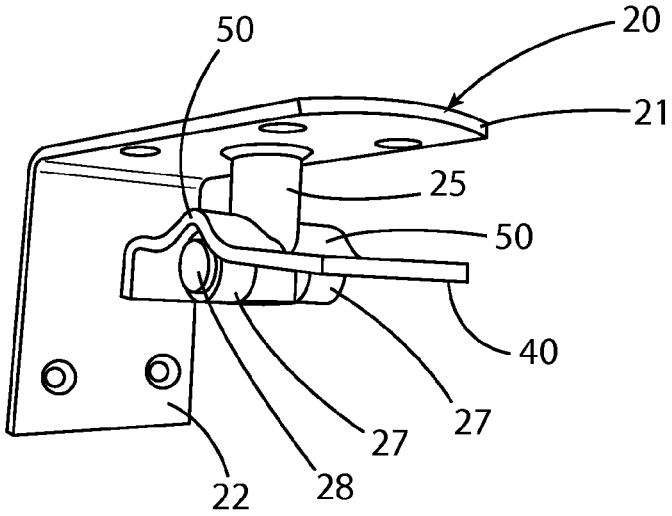
FIG. 6 is a perspective view of the support plate engaged with a roller assembly oriented for a door in an open position.
Figure 7:
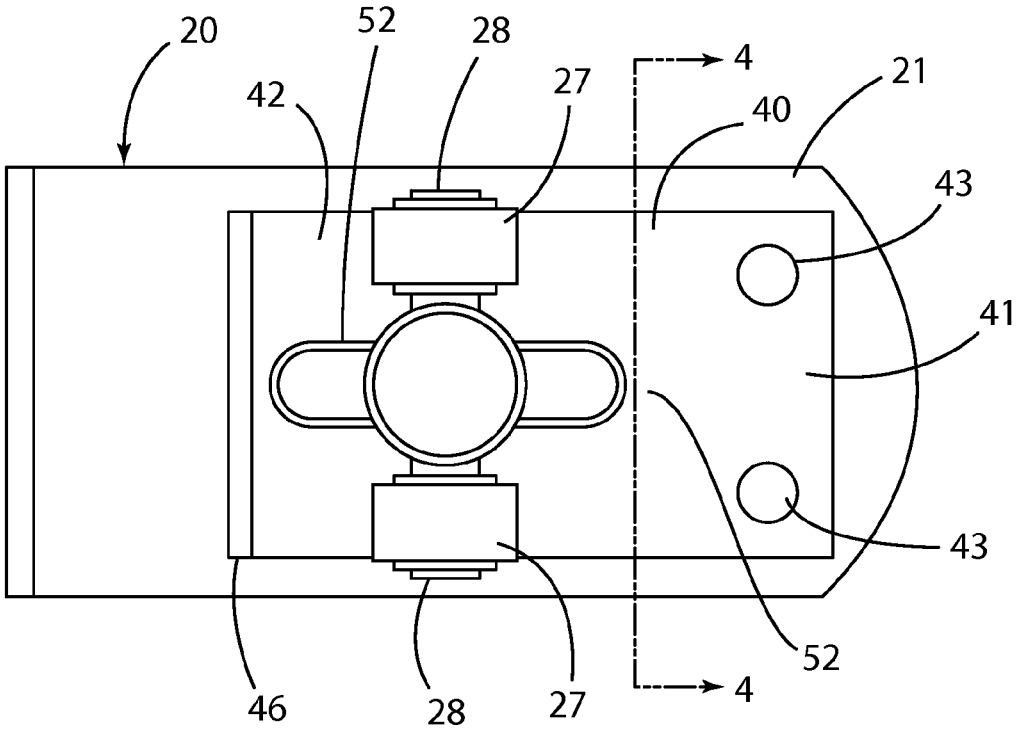
FIG. 7 is a bottom view of FIG. 6.
Figure 8:
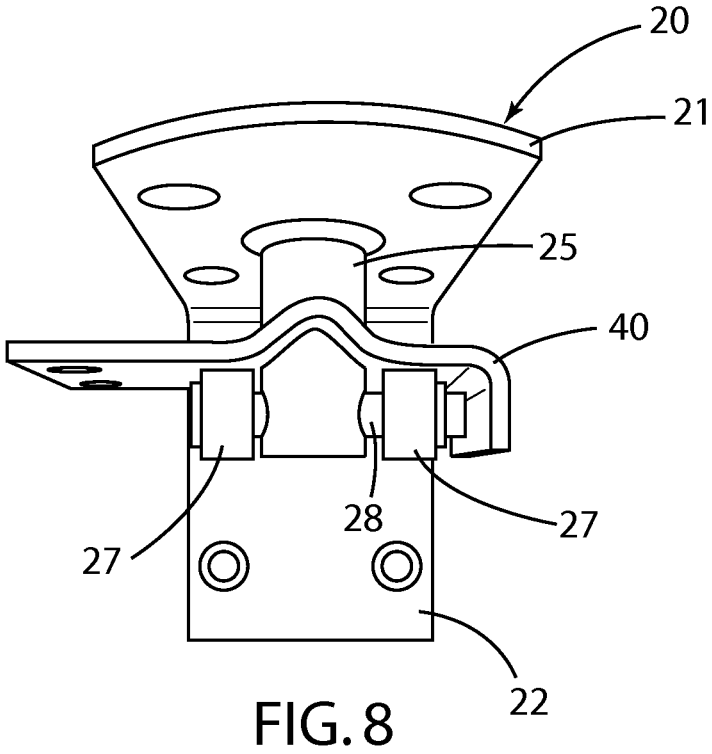
FIG. 8 is a perspective view of the support plate and roller assembly in a condition when the door is held in an open position.
Figure 9:
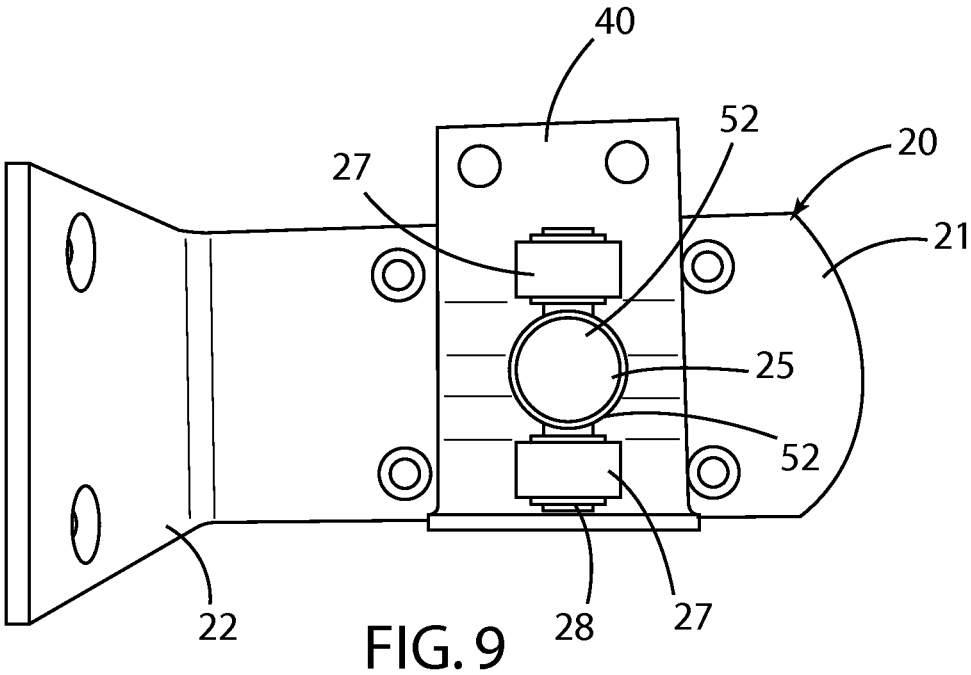
FIG. 9 is a bottom view thereof.

FIGS. 6 and 7 illustrate the support plate 40 in the normally closed orientation with the rollers 27 seated within the centering notches 50. To define the hold open feature, the support plate 40 also includes a pair of diametrically opposite restraining slots 52 which extend radially outwardly from the center bore 49 and are oriented diametrically opposite to each other as seen in FIG. 33. The restraining slots 52 are oriented preferably at 90° or right angles relative to the centering notches 50. While the restraining slots 52 extend entirely through the support plate 40 as seen in FIG. 3A and FIG. 7, the support plate 40 also may be modified somewhat so that the restraining slots 52 are shallower and only extend partway through the thickness of the plate 40 to define arcuate recesses 52A. For the slots 52 of FIG. 3A and FIG. 7, the U-shaped edge 53 of each slot 52 is beveled or angled to have an angled and arcuate incline and generally conform to the outside diameter of the rollers 27. As seen in FIG. 4, the shallower recesses 52A also have a similar arcuate shape to conform to the outside diameter of the roller 27 and thereby positively seat the roller 27 within such slots 52 or 52A. FIGS. 8 and 9 illustrate the rollers 27 when they seat within the slots 52 which occurs when the plate 40 and the associated door 11 have been rotated 90° to either one of the open positions. FIG. 2 illustrates the door 11 in the first open position, while FIG. 9 illustrates the plate 40 rotated to the other open position with the plate 40 oriented 180° relative to the orientation of the plate 40 in FIG. 2. These define the preferred first and second open positions for the door 11 which each are preferably oriented at a right angle relative to the normally closed position of FIG. 1.

Positive seating of the rollers 27 within the restraining slots 52 occurs as the rollers 27 essentially seat vertically within the slots 52. In this regard, as the rollers 27 roll upon the flat bottom surface of the support plate 40, they eventually will roll up the inclined perimeter edges 53 of the slots 52 wherein the door 11 displaces vertically downwardly as the rollers 27 align with the slots 52 and the slots 52 fall downwardly onto the rollers 27. Upon closing of the door, the rollers 27 reverse directions and the slots 52 or 52A roll up along the rollers 27 which causes the door 11 to shift vertically upwardly until the door 11 returns to the closed position, wherein the rollers 27 then seat within the centering notches 50 during which time, the door again shifts downwardly. Thus, this invention requires that the door 11 be vertically shiftable to a limited extent.

In this manner, the support plate 40 can be provided with both a positive centering feature maintaining the door 11 in a normally closed position, and a hold open feature which restrains the door in the fully open position due to the provision of the restraining slots 52. This allows the door 11 to be simply maintained through its own top pin assembly 12 in either of two open positions. This does not require any additional separate devices to restrain the door 11 and simply occurs as the door 11 is opened to the fully open position, at which time the rollers 27 vertically engage the slots 52 or 52A. The engagement of the rollers 27 with the slots 52 or 52A requires a relatively low amount of force to disengage these components and return the door 11 to the closed position, but such resistance to closing is not significant and can be readily overcome by manual pushing of the door 11 towards the closed position.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A hinge assembly for a self-closing, bidirectionally swinging door which is swingable between an open position and a normally closed position, said hinge assembly comprising:

a frame-mountable first bracket assembly comprising a frame bracket mountable on a door frame proximate an upper portion of a door, and a hinge pin projecting vertically downwardly from said frame bracket, said hinge pin defining a vertically extending pivot axis for a door and having a bottom end and a roller assembly supported on said bottom end, said roller assembly comprising at least one roller which is rotatable about a horizontally extending roller axis and has an outer circumferential roller surface; and a door-mountable second bracket assembly comprising a door bracket unit which is mountable to a door for suspending the door from said first bracket assembly for swinging rotation about said pivot axis, said second bracket assembly including a top support plate having a central bore wherein a pair of first plate sections are disposed on opposite sides of said central bore in a first direction and a pair of second plate sections are disposed on opposite sides of said central bore in a second direction transverse to said first direction, said hinge pin projecting vertically downwardly through said central bore with said roller being disposed vertically below said top support plate to vertically carry said second bracket assembly and permit rotation of said second bracket assembly relative to said first bracket assembly about said pivot axis for swinging of a door between open and closed positions;

said roller having a respective one of said first plate sections supported vertically on said roller surface, wherein at least one of said first plate sections includes a respective centering notch which receives said roller within said notch to rotationally bias said top plate to a first position corresponding to a closed position of a door, said second bracket assembly being displaceable vertically relative to said hinge pin wherein vertical displacement of said second bracket assembly permits said roller to move vertically out of said centering notch during rotation of said top plate to a second position corresponding to an open position of a door supported by said second bracket assembly; and at least one of said second plate sections of said top plate including a restraining slot which receives said roller to restrain said top plate in said second position wherein said vertical displacement of said second bracket assembly permits said roller to move out of said restraining slot during return of said second bracket assembly to said first position.

2. The hinge assembly according to claim 1, wherein said roller is supported on a roller shaft which permits rotation of said roller relative to said hinge pin about said roller axis.

3. The hinge assembly according to claim 1, which comprises a pair of said rollers disposed on opposite sides of said hinge pin.

4. The hinge assembly according to claim 1, wherein a pair of said rollers are supported on a roller shaft which permits rotation of said rollers relative to said hinge pin about said roller axis, said rollers supporting said first plate sections on opposite sides of said central bore.

5. The hinge assembly according to claim 4, wherein each of said first plate sections includes one said centering notch and each of said second plate sections includes one said restraining slot, said rollers being movable about said central bore between said centering notches and said restraining slots.

6. The hinge assembly according to claim 5, wherein each said centering notch is formed by deformation of said top plate into a V-shaped recess which defines said notch.

7. The hinge assembly according to claim 6, wherein each said restraining slot opens vertically through said top plate.

8. The hinge assembly according to claim 1, wherein each said centering notch is formed by deformation of said top plate into a V-shaped recess which defines said notch.

9. The hinge assembly according to claim 8, wherein each said restraining slot opens vertically through said top plate.

10. A hinge assembly for a self-closing, bidirectionally swinging door which is swingable between an open position and a normally closed position, said hinge assembly comprising:

a frame-mountable first bracket assembly comprising a frame bracket mountable on a door frame proximate an upper portion of a door, and a hinge pin projecting vertically downwardly from said frame bracket, said hinge pin defining a vertically extending pivot axis for a door and having a bottom end and a roller assembly supported on said bottom end, said roller assembly comprising a plurality of rollers which are rotatable about a horizontally extending roller axis and each has an outer circumferential roller surface; and a door-mountable second bracket assembly comprising a door bracket unit which is mountable to a door for suspending the door from said first bracket assembly for swinging rotation about said pivot axis, said second bracket assembly including a top support plate having a central bore and comprising a pair of side plate sections disposed on opposite sides of said central bore in a first sideward direction and a pair of end plate sections disposed on opposite sides of said central bore in a second end-to-end direction transverse to said first direction, said hinge pin projecting vertically downwardly through said central bore with said rollers being disposed vertically below said top support plate to vertically carry said second bracket assembly and permit rotation of said second bracket assembly relative to said first bracket assembly about said pivot axis for swinging of a door between open and closed positions;

each said roller having a respective one of said side plate sections supported vertically on said roller surface, wherein each of said side plate sections includes a respective centering notch which receives said roller within said notch to rotationally bias said top plate to a first position corresponding to a closed position of a door, said second bracket assembly being displaceable vertically relative to said hinge pin wherein vertical displacement of said second bracket assembly permits said roller to move vertically out of said centering notch during rotation of said top plate to a second position corresponding to an open position of a door supported by said second bracket assembly; and each of said end plate sections of said top plate including a restraining slot which receives said roller to restrain said top plate in said second position wherein said vertical displacement of said second bracket assembly permits said roller to move out of said restraining slot during return of said second bracket assembly to said first position.

11. The hinge assembly according to claim 10, wherein said rollers are supported on a roller shaft which permits rotation of said rollers relative to said hinge pin about said roller axis, said rollers supporting said first plate sections on opposite sides of said central bore.

12. The hinge assembly according to claim 10, wherein said rollers are movable about said central bore between said centering notches and said restraining slots.

13. The hinge assembly according to claim 10, wherein each said centering notch is formed by deformation of said top plate into a V-shaped recess which defines said notch.

14. The hinge assembly according to claim 13, wherein each said V-shaped recess includes inclined sides which normally bias said roller to a center position of said notch.

15. The hinge assembly according to claim 10, wherein each said restraining slot opens vertically from at least one side of said top plate.

16. The hinge assembly according to claim 15, wherein each said restraining slot has angled edges which normally bias said roller into said slot and restrains said roller therein.

17. The hinge assembly according to claim 16, wherein each said slot is cut vertically through the entire thickness of said top plate.

* * * * *